US012628917B1

(12) United States Patent
Tang

(10) Patent No.: US 12,628,917 B1
(45) Date of Patent: May 19, 2026

(54) BELT

(71) Applicant: Xin Tang, Ji'an (CN)

(72) Inventor: Xin Tang, Ji'an (CN)

( * ) Notice: Subject to any disclaimer, the term of this patent is extended or adjusted under 35 U.S.C. 154(b) by 0 days.

(21) Appl. No.: 19/300,179

(22) Filed: Aug. 14, 2025

(51) Int. Cl.
*A44B 11/02* (2006.01)
*A41F 9/02* (2006.01)

(52) U.S. Cl.
CPC ..... *A44B 11/02* (2013.01); *A41F 9/025* (2013.01)

(58) Field of Classification Search
CPC ..... A44B 11/02; A41F 9/025; A41F 9/002; Y10T 24/2147; Y10T 24/2192; Y10T 24/4086; Y10T 24/4736; Y10T 24/2104; Y10T 24/2113; Y10T 24/2117; Y10T 24/2142
See application file for complete search history.

(56) References Cited

U.S. PATENT DOCUMENTS 4,669,155 A * 6/1987 Chen ..... A41F 9/002 24/191
5,606,779 A * 3/1997 Lu ..... A43C 11/146 24/68 SK
9,155,359 B1 * 10/2015 Bailey ..... A44B 11/065
2002/0000707 A1 * 1/2002 Couderc ..... A43C 11/1406 280/611
2008/0150259 A1 * 6/2008 Veyrat-Charvillon ..... A63C 10/06 36/114
2019/0200711 A1 * 7/2019 Simpson ..... A44B 11/125

* cited by examiner

*Primary Examiner* — Jack W Lavinder
(74) *Attorney, Agent, or Firm* — Daniel M. Cohn; Howard M. Cohn

(57) ABSTRACT

The present invention discloses a novel belt, comprising a strap and a fastening component. One end of the strap is mounted on the fastening component, while the other end serves as a free end. The free end of the strap is provided with a mounting groove, the inner wall of which is formed with multiple teeth. The fastening component is provided with a limiting element and a driving assembly. The limiting element engages between adjacent teeth to restrain the strap. The driving assembly is configured to drive the limiting element to rotate, thereby disengaging the limiting element and releasing the strap. The invention further includes an adjustment assembly, by which the tightness of the strap can be adjusted, preventing discomfort to the user during adjustment and facilitating easier regulation of strap tension.

7 Claims, 8 Drawing Sheets

BELT

TECHNICAL FIELD

The present invention relates to the technical field of belts, and more particularly, to a novel belt.

BACKGROUND ART

A belt is a tool used for fastening around the waist.

A typical belt consists of a belt body and a fastening component. The belt body passes through the middle of the fastening component, and by pulling and moving the belt body, the tightness of the belt around the waist can be adjusted. However, in currently available belts on the market, adjusting the tightness of the belt typically involves directly pulling on the free end of the belt body. During this process, it is often difficult for the user to control the applied force, which commonly leads to over-adjustment—that is, the belt becomes excessively tight around the user's waist. In such cases, the user must operate the limit switch on the fastening component to release the belt body, and then readjust the tightness.

Therefore, traditional belts may have the following problem: during the adjustment process, it is difficult to control the applied force. To address this and facilitate easier adjustment of tightness for the user, the present device introduces a novel belt design.

SUMMARY OF THE INVENTION

The purpose of this invention is to address the shortcomings in the existing technology by proposing a novel belt.

To achieve the above objective, the invention adopts the following technical solution:

A novel belt, comprising a belt body and a buckle component. One end of the belt body is attached to the buckle component, and the other end of the belt body is a free end.

An installation slot is formed on the sidewall of the free end of the belt body. Multiple teeth are fixedly installed on the inner wall of the installation slot. A limit piece is rotatably mounted on the buckle component, and one side of the limit piece is engaged between two adjacent teeth to secure the belt body.

A drive assembly is installed on the buckle component, which is used to drive the limit piece to rotate so that it disengages from the adjacent teeth and releases the constraint on the belt body.

An adjustment assembly is also rotatably mounted on the buckle component, which is used to actuate the teeth, allowing the buckle component to move along the belt body.

The above technical solution further includes: the locking component comprises a housing, with side plates fixedly installed respectively on the opposite side walls of the housing. Multiple second mounting holes are formed on the outer wall of the housing, and multiple first mounting holes are formed on the outer wall of the belt body. The belt body and the housing are fixedly connected as an integral unit by bolts.

The limiting element includes a shaft rotatably installed on the opposite side walls of the two side plates. A limiting frame is fixedly mounted on the outer wall of the shaft. The limiting frame is movably arranged between two adjacent teeth.

The driving assembly includes a release frame rotatably mounted on a frame body. A first driving member is fixedly installed on the release frame. Two driving racks are fixedly mounted on the outer wall of the first driving member. Two push blocks are fixedly installed on the side wall of the limiting frame. The driving racks are configured to drive the push blocks to move.

The adjustment assembly includes an adjustment frame rotatably mounted on the housing. A second driving member is fixedly installed on the adjustment frame. A pawl frame is fixedly installed on the outer wall of the second driving member. The second driving member is configured to push the teeth.

A first torsion spring is sleeved on the shaft. One end of the first torsion spring is fixedly connected to the outer wall of the shaft, and the other end is fixedly connected to the inner wall of the housing.

A second torsion spring is sleeved on the rotating shaft of the adjustment frame. One end of the second torsion spring is fixedly connected to the outer wall of the rotating shaft of the adjustment frame, and the other end is fixedly connected to the inner wall of the housing.

Compared with the prior art, the beneficial effects of the invention are as follows:

The invention is equipped with an adjustment assembly, which allows stepwise adjustment of the belt body's tightness. This avoids excessive pulling that causes the belt to bind too tightly around the user's waist, reduces the occurrence of discomfort caused by sudden overly tight binding during adjustment, and makes the tightening adjustment process more convenient.

Opposite side walls of the teeth are respectively provided with card slots. Card ribs are arranged on the side walls of the side plates. The card ribs are slidably connected to the inner walls of the card slots.

10, Canister body; 11, Installation groove; 12, Teeth; 121, Groove;

13, First installation hole; 21, Shell; 211, Second installation hole;

22, Side plate; 221, Rib; 23, Release frame; 24, Adjustment frame; 241, Second torsion spring; 25, First driving component; 251, Driving frame; 26, Shaft;

261, Limit frame; 2601, First torsion spring; 262, Top block; 27, Second driving component;

271, Pushing frame.

DETAILED DESCRIPTION OF THE EMBODIMENTS

The following further describes the technical solutions of the present invention in conjunction with the accompanying drawings and specific embodiments.

Embodiment 1

Figure 1:
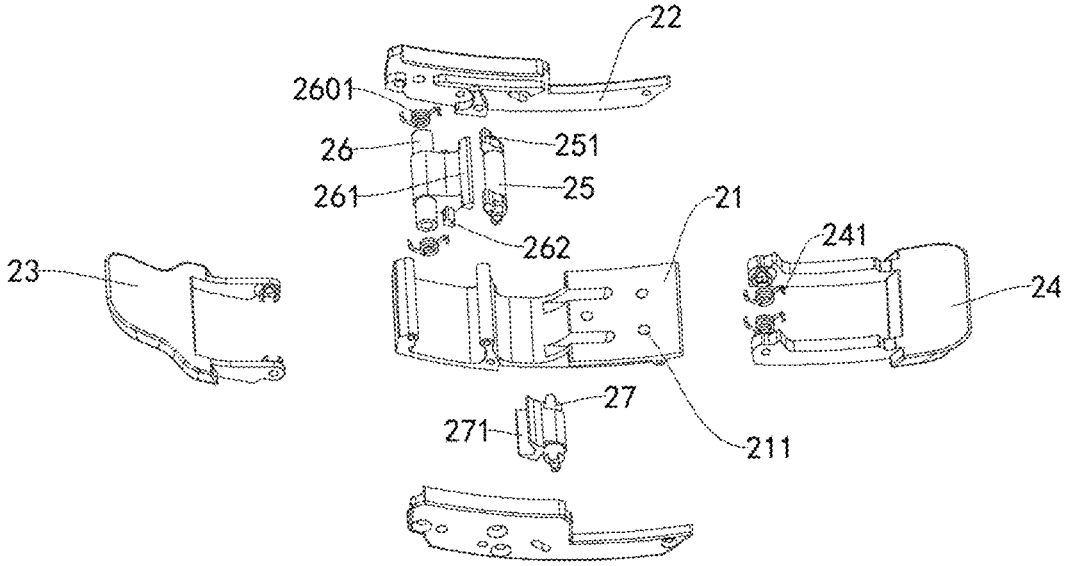
FIG. 1 is an exploded view of the locking component.
Figure 2:
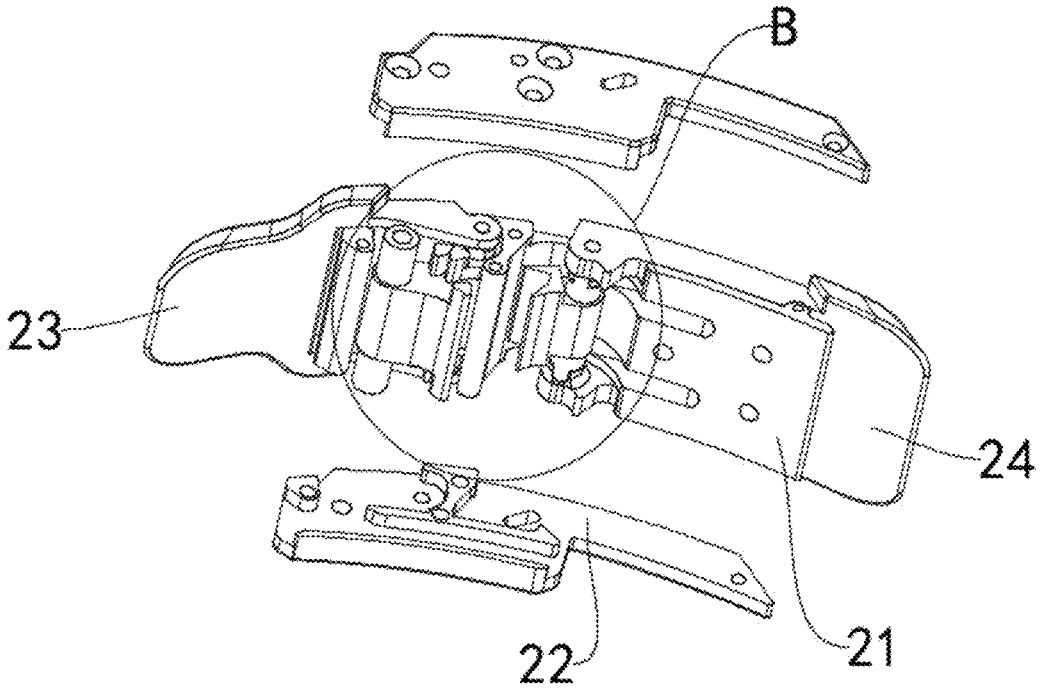
FIG. 2 is a partial disassembled view of the locking component.
Figure 3:
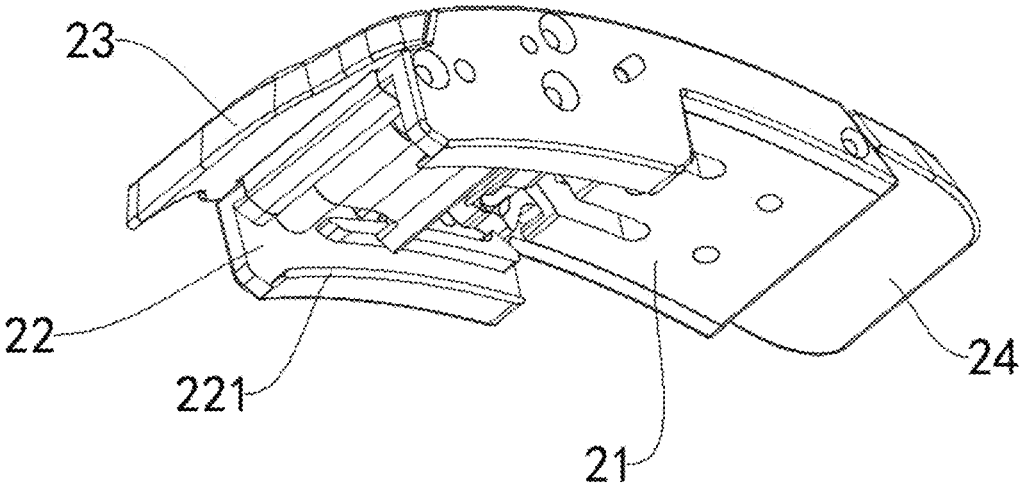
FIG. 3 is an overall structural view of the locking component.
Figure 4:
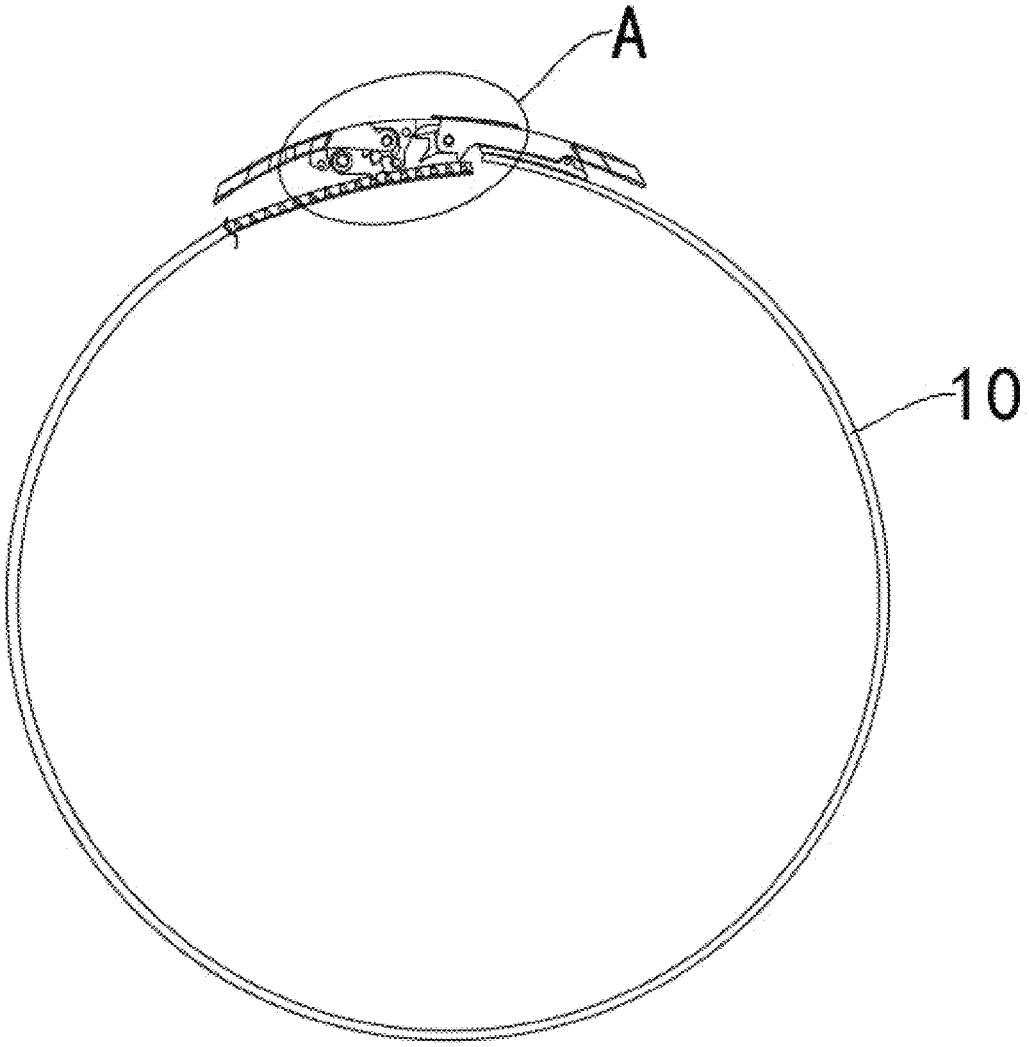
FIG. 4 is a structural schematic of the belt body.
Figure 5:
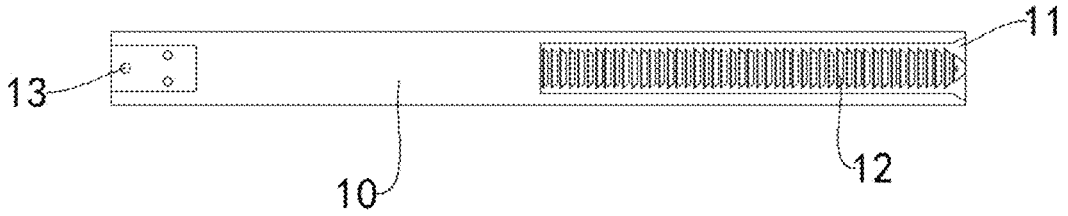
FIG. 5 is another structural schematic of the belt body.
Figure 6:
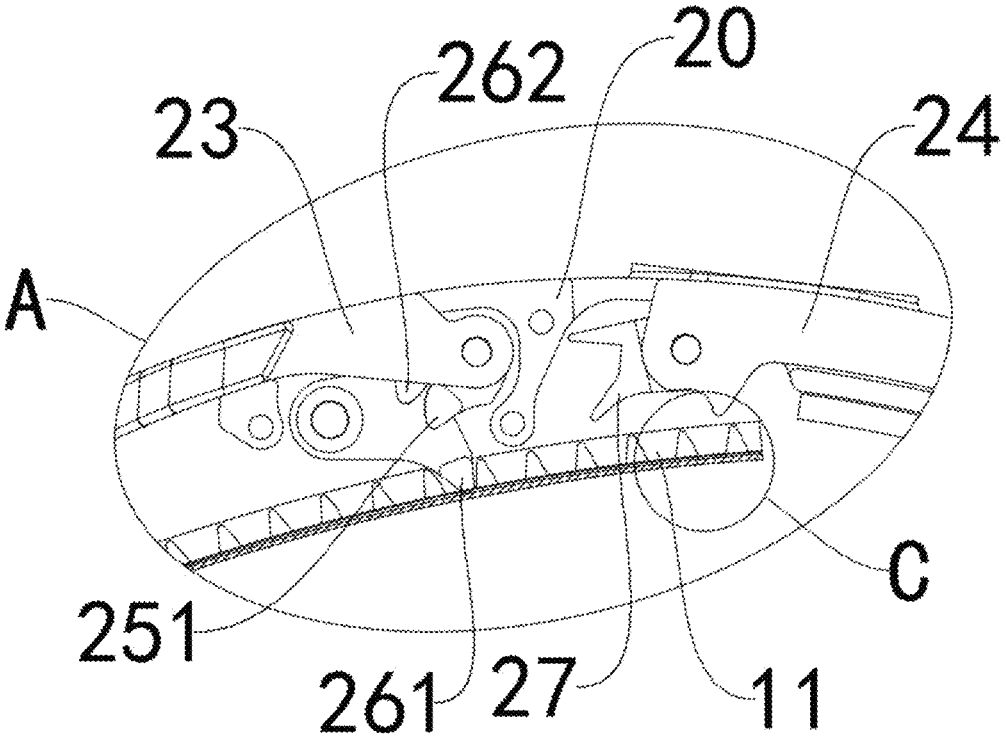
FIG. 6 is an enlarged structural view of part A in FIG. 4.
Figure 7:
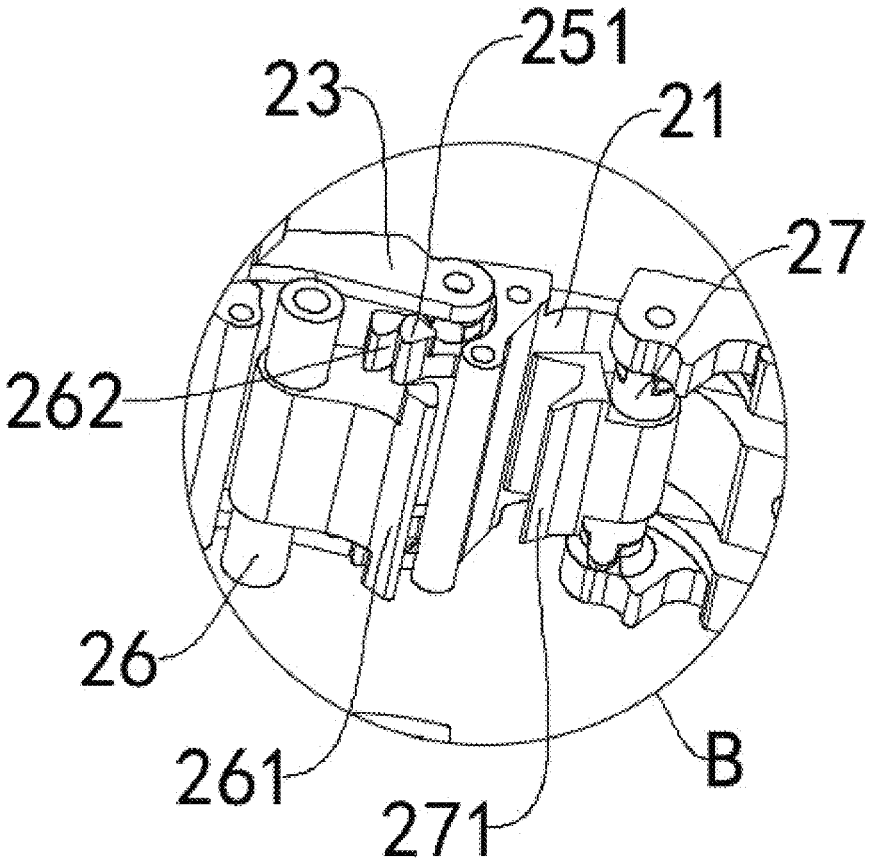
FIG. 7 is an enlarged structural view of part B in FIG. 2.
Figure 8:
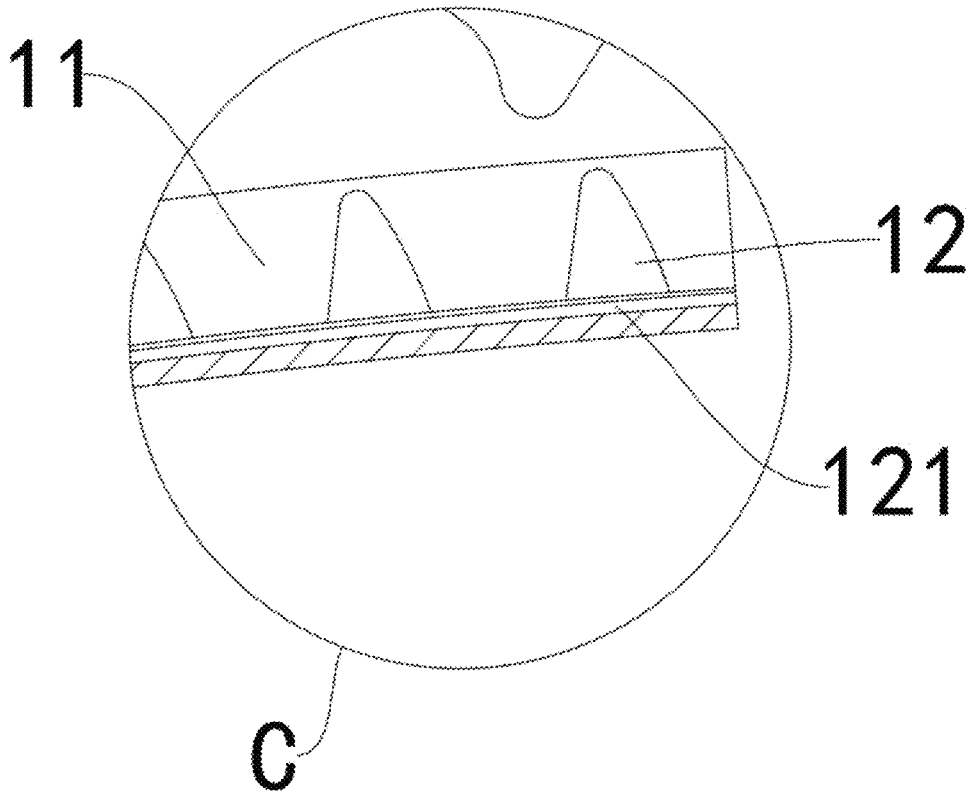
FIG. 8 is an enlarged structural view of part C in FIG. 6.

Referring to FIGS. 1 to 8, the present invention proposes a novel belt, comprising a belt body 10 and a locking component; one end of the belt body 10 is mounted on the locking component, and the other end of the belt body 10 is a free end.

A mounting groove 11 is formed on the side wall of the free end of the belt body 10, with multiple teeth 12 fixedly mounted on the inner wall of the mounting groove 11. A limiting component is rotatably arranged on the locking component, with one side of the limiting component engaged between two adjacent teeth 12 to restrict the belt body 10.

A driving assembly is provided on the locking component, configured to drive the limiting component to rotate, thereby disengaging the limiting component from between two adjacent teeth 12 and releasing the restriction on the belt body 10.

An adjustment assembly is also rotatably arranged on the locking component, the adjustment assembly being configured to push the teeth 12, enabling the locking component to move along the belt body 10.

The locking component includes a housing 21, with side plates 22 fixedly installed respectively on the opposite side walls of the housing 21. Multiple second mounting holes 211 are formed on the outer wall of the housing 21, and multiple first mounting holes 13 are formed on the outer wall of the belt body 10. The belt body 10 and the housing 21 are fixedly connected as an integral unit by bolts.

The limiting component includes a shaft 26 rotatably mounted on the opposite side walls of the two side plates 22. A limiting frame 261 is fixedly mounted on the outer wall of the shaft 26, and the limiting frame 261 is movably arranged between two adjacent teeth 12.

The driving assembly includes a release frame 23 rotatably mounted on a frame body. A first driving member 25 is fixedly installed on the release frame 23. Two driving racks 251 are fixedly installed on the outer wall of the first driving member 25. Two push blocks 262 are fixedly installed on the side wall of the limiting frame 261. The driving racks 251 are configured to drive the push blocks 262 to move. Specifically, the push blocks 262 are located along the movement trajectory of the driving racks 251. When the driving racks 251 rotate, they can cause the push blocks 262 to rotate.

The adjustment assembly includes an adjustment frame 24 rotatably mounted on the housing 21. A second driving member 27 is fixedly installed on the adjustment frame 24. The second driving member 27 is configured to push the teeth 12.

The opposite side walls of the teeth 12 are each provided with a card slot 121. Card ribs 221 are arranged on the side walls of the side plates 22. The card ribs 221 are slidably connected to the inner walls of the card slots 121. When installing the locking component onto the belt body 10, the locking component is first inserted into the mounting groove 11 from the inside. Then, the two card ribs 221 are respectively inserted into the two card slots 121, allowing the locking component to be installed onto the belt body.

The first torsion spring 2601 is mounted on shaft 26, with one end fixedly connected to the outer wall of shaft 26, and the other end fixedly connected to the inner wall of shell 21. The first torsion spring 2601 enhances the stability of the release frame 23 by restricting the movement of shaft 26.

The second torsion spring 241 is mounted on the rotating shaft of the adjustment frame 24. One end of the second torsion spring 241 is fixedly connected to the outer wall of the rotating shaft of the adjustment frame 24, and the other end is fixedly connected to the inner wall of shell 21. The second torsion spring 241 enhances the stability of the adjustment frame 24 by restricting its movement.

In this embodiment, when the user adjusts the tightness of the belt, one hand holds the housing 21 while the other hand rotates the adjustment frame 24. As the adjustment frame 24 rotates, it drives the second driving member 27 to rotate. During the rotation of the second driving member 27, it pushes the teeth 12, causing the free end of the belt body 10 to move inside the locking component. When the free end of the belt body 10 moves, the limiting frame 261 is forced to rotate under the pressure of the teeth 12. After the limiting frame 261 rotates to a certain position, as the belt body 10 continues to move, the limiting frame 261 can enter the next card slot (the slot formed between two adjacent teeth 12). At this point, the limiting frame 261 fixes the belt body 10 in place. By repeating this process, each time the adjustment frame 24 is rotated once, the limiting frame 261 moves step-by-step into the next adjacent card slot, thereby achieving a gradual adjustment of the tightness of the belt body 10.

The above description only illustrates the preferred embodiments of the present invention. However, the protection scope of the present invention is not limited thereto. Any person skilled in the art, within the technical scope disclosed by this utility model, may make equivalent substitutions or modifications based on the technical solutions and inventive concepts of the present invention, and such substitutions or modifications should be encompassed within the protection scope of the present invention.

The invention claimed is:

1. A novel belt, characterized in that it comprises a belt body (10) and a locking component; one end of the belt body (10) is mounted on the locking component, and an other end of the belt body (10) is a free end; a mounting groove (11) is formed on a side wall of the free end of the belt body (10), and a plurality of teeth (12) are fixedly mounted on an inner wall of the mounting groove (11); a limiting element is rotatably arranged on the locking component, one side of the limiting element engaged between two adjacent ones of the teeth (12) to restrict the movement of the belt body (10); a driving assembly is provided on the locking component, configured to drive the limiting element to rotate so that the limiting element disengages from between the two adjacent ones of the teeth (12), thereby releasing the restriction on the belt body (10); an adjustment assembly is further rotatably arranged on the locking component, the adjustment assembly being configured to push the teeth (12) so that the locking component can move along the belt body (10); the driving assembly includes a release frame (23) rotatably mounted on a frame body; a first driving member (25) is fixedly installed on the release frame (23); two driving racks (251) are fixedly installed on an outer wall of the first driving member (25); two push blocks (262) are fixedly installed on a side wall of the limiting frame (261); the two driving racks (251) are configured to drive the two push blocks (262) to move.

2. The novel belt according to claim 1, characterized in that the locking component comprises a housing (21); side plates (22) are fixedly installed on opposite side walls of the housing (21); a plurality of second mounting holes (211) are formed on an outer wall of the housing (21), and a plurality of first mounting holes (13) are formed on an outer wall of the belt body (10); the belt body (10) and the housing (21) are fixedly connected together by bolts.

3. The novel belt according to claim 2, characterized in that the limiting element includes a shaft (26) rotatably mounted on the opposite side walls of said two side plates (22); a limiting frame (261) is fixedly mounted on an outer wall of the shaft (26); the limiting frame (261) is movably arranged between two adjacent ones of the teeth (12).

4. The novel belt according to claim 3, characterized in that a first torsion spring (2601) is sleeved on the shaft (26); one end of the first torsion spring is fixedly connected to an outer wall of the shaft (26); and the other end of the first torsion spring is fixedly connected to an inner wall of the housing (21).

5. The novel belt according to claim 2, characterized in that the adjustment assembly comprises an adjustment frame (24) rotatably mounted on the housing (21); a second driving member (27) is fixedly installed on the adjustment frame (24); a pawl frame (271) is fixedly installed on an outer wall of the second driving member (27); the second driving member (27) is configured to push the said teeth (12).

6. The novel belt according to claim 4, characterized in that opposite side walls of the teeth (12) are respectively provided with card slots (121); card ribs (221) are provided on side walls of the side plates (22); the card ribs (221) are slidably connected to inner walls of the card slots (121).

7. The novel belt according to claim 5, characterized in that a second torsion spring (241) is sleeved on a rotating shaft of the adjustment frame (24); one end of the second torsion spring is fixedly connected to an outer wall of the rotating shaft of the adjustment frame (24); and the other end of the second torsion spring is fixedly connected to an inner wall of the housing (21).

* * * * *